US009221651B2

(12) United States Patent
Thomas et al.

(10) Patent No.: US 9,221,651 B2
(45) Date of Patent: Dec. 29, 2015

(54) SWINGING SHEAVE BRACKET WITH FORCE CONTROL

(71) Applicant: Joy MM Delaware, Inc., Wilmington, DE (US)

(72) Inventors: Terry M. Thomas, Franklin, PA (US); Brian J. Hoffman, Harrisville, PA (US); Adam S. Peterson, Franklin, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 110 days.

(21) Appl. No.: 13/714,169

(22) Filed: Dec. 13, 2012

(65) Prior Publication Data

US 2013/0146410 A1 Jun. 13, 2013

Related U.S. Application Data

(60) Provisional application No. 61/569,874, filed on Dec. 13, 2011.

(51) Int. Cl.

| | |
|---|---|
| ***B65H 59/00*** | (2006.01) |
| ***B65H 59/22*** | (2006.01) |
| ***B65H 75/44*** | (2006.01) |
| ***B65H 57/14*** | (2006.01) |
| ***B65H 59/36*** | (2006.01) |
| ***B65H 75/42*** | (2006.01) |
| ***E21F 13/02*** | (2006.01) |

(52) U.S. Cl.

CPC ..... *B65H 59/22* (2013.01); *B65H 57/14* (2013.01); *B65H 59/36* (2013.01); *B65H 75/425* (2013.01); *B65H 75/44* (2013.01); *E21F 13/025* (2013.01); *B65H 2701/34* (2013.01)

(58) Field of Classification Search

CPC ..... B65H 59/22; B65H 59/24; B65H 59/16; B65H 59/32; B65H 59/36; B65H 75/44; B65H 57/14; B65H 75/425; B65H 2701/34

USPC ..... 191/12.2 R, 12.2 A; 242/417.3, 397.2, 242/390.8, 153

See application file for complete search history.

(56) References Cited

U.S. PATENT DOCUMENTS

| | | | | |
|---|---|---|---|---|
| 3,366,344 | A * | 1/1968 | Smith et al. | 242/390 |
| 3,836,089 | A * | 9/1974 | Riemersma | 242/417.3 |
| 4,047,599 | A * | 9/1977 | Rousseau | 191/12.2 A |
| 6,530,537 | B2 * | 3/2003 | Hanlon | 242/390.8 |
| 2002/0104915 | A1 * | 8/2002 | Hanlon | 242/397.2 |
| 2010/0300826 | A1 * | 12/2010 | Peterson et al. | 191/12.2 R |

(Continued)

OTHER PUBLICATIONS

First Office Action from the Australian Intellectual Property Office for Application No. 2012261773 dated Mar. 14, 2014 (4 pages).

(Continued)

*Primary Examiner* — Jason C Smith

(74) *Attorney, Agent, or Firm* — Michael Best & Friedrich LLP

(57) ABSTRACT

A sheave bracket directs a trailing cable of a mining vehicle. The bracket is hingedly secured to the vehicle and includes a plate and a plurality of sheaves coupled to and extending from the plate. The sheaves are arranged to guide the cable. The sheave bracket also includes a force control mechanism movable between two positions to adjust tension in the cable. The force control mechanism dampens strain in the cable when the direction of the bracket is changed.

22 Claims, 4 Drawing Sheets

(56) References Cited

U.S. PATENT DOCUMENTS

| | | | | |
|---|---|---|---|---|
| 2011/0089284 | A1* | 4/2011 | Bartolone | 242/417.3 |
| 2011/0184597 | A1* | 7/2011 | Thomas et al. | 701/22 |
| 2013/0146410 | A1* | 6/2013 | Thomas et al. | 191/12.2 R |
| 2014/0166419 | A1* | 6/2014 | Krellner et al. | 191/12.2 R |

OTHER PUBLICATIONS

Examination Report from the United Kingdom Intellectual Property Office for Application No. 1222364.0 dated May 28, 2014 (3 pages).

GB1222364.0 Great Britain Search Report dated Apr. 10, 2013 (3 pages).

* cited by examiner

SWINGING SHEAVE BRACKET WITH FORCE CONTROL

CROSS-REFERENCE TO RELATED APPLICATIONS

This application claims the benefit of U.S. Provisional Patent Application No. 61/569,874, filed Dec. 13, 2011, the entire contents of which are hereby incorporated by reference.

BACKGROUND OF THE INVENTION

The present invention relates to movable electric machinery having a trailing cable connected to a source of power, and, more particularly, to a sheave bracket assembly for preventing the cable from contacting the movable electric machinery.

Haulage equipment, such as shuttle cars, in the mining industry efficiently removes cut material from a working face in such a manner so as to enhance the performance of a continuous miner and maximize productivity. A conventional rigid sheave bracket attached to a front of a shuttle car has no means to absorb the inertial force (from cable direction change) while passing the shuttle car trailing cable tie-off point. Damage caused to the cable by shock resulting from this change of direction is one of the largest costs associated with maintenance of shuttle cars.

SUMMARY OF THE INVENTION

In one embodiment, a sheave bracket directs a trailing cable of a mining vehicle. The bracket is hingedly secured to the vehicle and includes a plate and a plurality of sheaves coupled to and extending from the plate. The sheaves are arranged to guide the cable. The sheave bracket also includes a force control mechanism coupled between the plate and a wall of the vehicle. The force control mechanism dampens strain in the cable when a direction of the bracket is changed.

In another embodiment, a sheave bracket assembly is hingedly secured to a mining vehicle and includes a plurality of first sheaves coupled to and extending from a first plate hingedly secured to the vehicle, a second sheave coupled to and extending from a second plate, the second plate coupled to an arm member hingedly secured to the vehicle, and a force control mechanism coupled between the second plate and the arm member. The force control mechanism dampens strain in the cable when the direction of the bracket is changed.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

DETAILED DESCRIPTION

Figure 1:
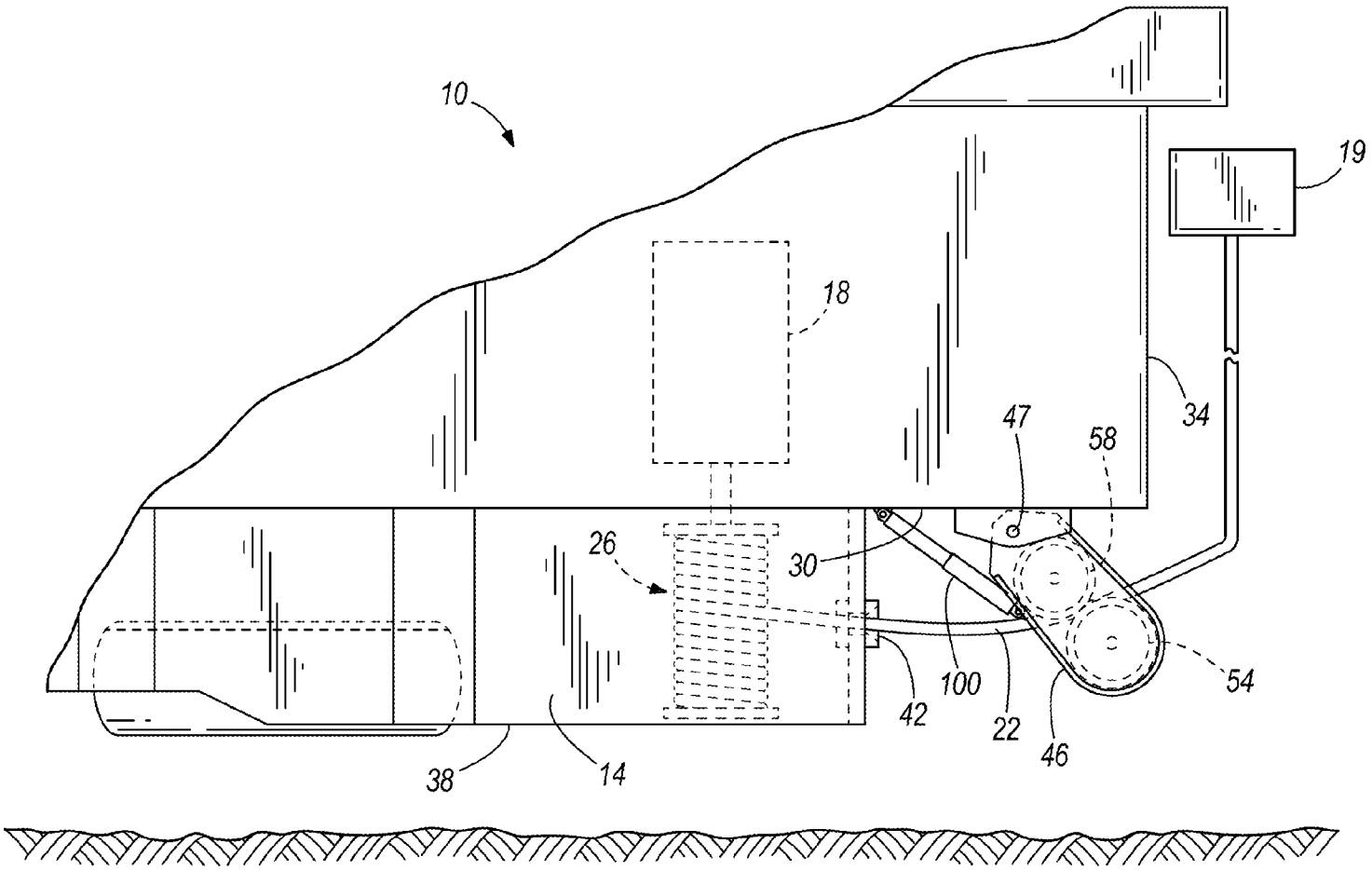
FIG. 1 is a partial top plan view of a right front corner of a shuttle car.

FIG. 1 illustrates an electric vehicle 10 (such as a shuttle car) useful in hauling material in underground mines. The shuttle car 10 includes a vehicle frame 14, an electrical motor 18 supported on the frame 14, and a cable 22, which is electrically connected to the motor 18 and configured to be connected to a power source 19. The shuttle car 10 further includes a cable reel 26 on the frame 14 between the electric motor 18 and one end of the frame 14. In the illustrated embodiment, the reel 26 is located near a front 30 of the shuttle car 10, that is a rear portion of the vehicle frame 14, and is rotatable about an axis.

As the shuttle car 10 moves (e.g., backwards, forwards, and around corners, toward to or away from the power source), the cable 22 is either wound onto or paid out of the reel compartment 26. The cable 22 extends from a front 34 of the shuttle car 10, and, at times, either runs along the side 38 of the shuttle car 10, when the shuttle car 10 is moving forward or backward, or extends straight back from the shuttle car 10, when the shuttle car 10 is moving forward or backward (not shown). When the shuttle car 10 moves right around a corner, as shown in FIG. 1, the cable 22 runs along either the front 34 or the side 38 of the shuttle car 10.

Figure 2:
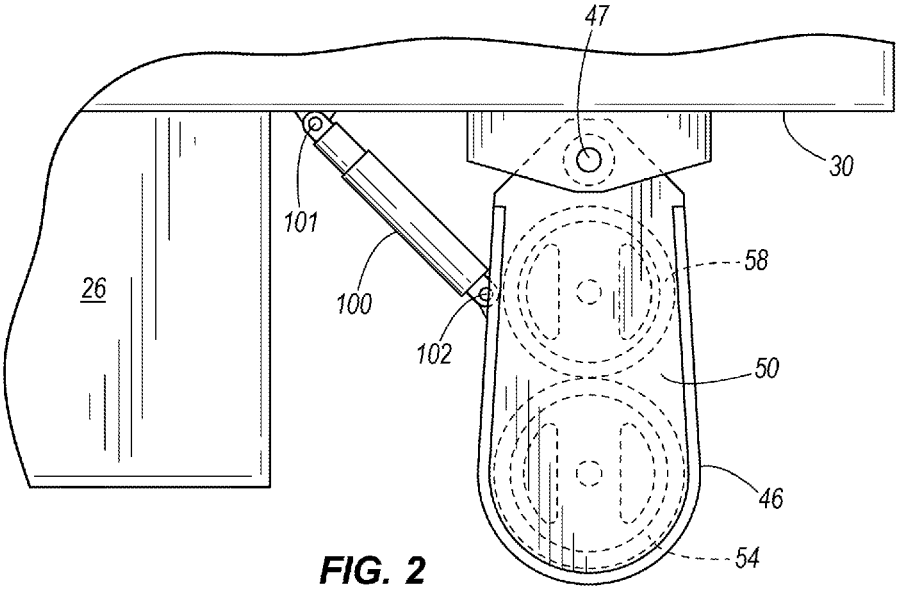
FIG. 2 is a top view of a swinging sheave bracket with a force control mechanism according to one embodiment of the invention, with the force control mechanism in a first position.
Figure 3:
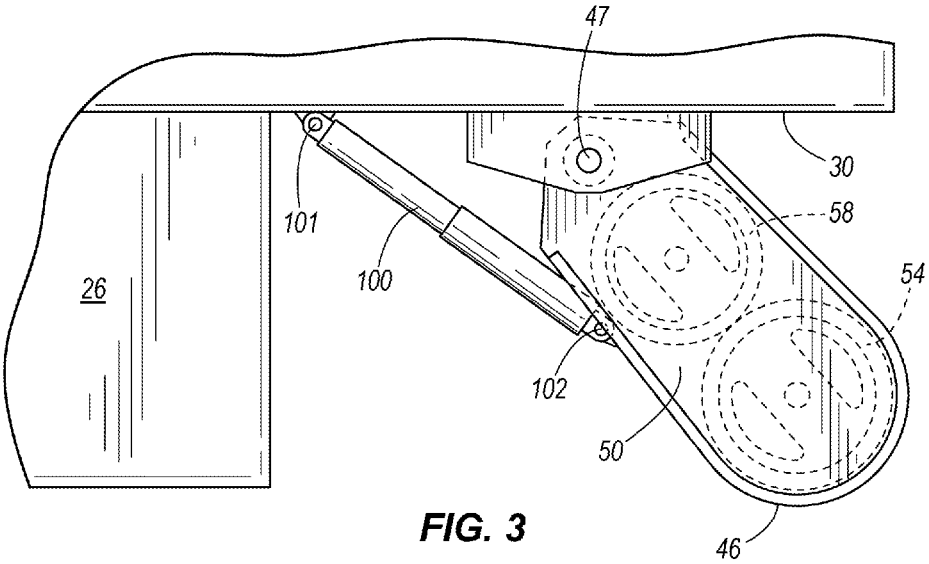
FIG. 3 is a top view of a swinging sheave bracket with the force control mechanism of FIG. 2 in a second position

The shuttle car 10 further includes a cable guide or spooling device 42 positioned between the reel 26 and the rear 34 of the shuttle car 10. However, the cable guide 42 could be positioned at other points along the shuttle car as well. A sheave bracket assembly 46 is hinged to the right front 30 of the shuttle car 10 at joint 47 to allow the sheave bracket assembly 46 to swing relative to the right front 30 of the shuttle car 10. As shown in FIGS. 2-3, the sheave bracket assembly 46 includes a lower mounting plate 50, and two spaced apart sheaves 54 and 58 rotatably mounted on the lower mounting plate 50.

With continued reference to FIG. 1, the cable 22 extends from the cable reel 26 through the cable guide 42, and then between the sheaves 54, 58. In certain applications, the cable 22 may have a length of between 500 and 1000 feet. The cable may be an AC cable or a DC cable.

FIGS. 1-3 illustrate the swinging sheave bracket 46 with a force control mechanism 100. In the illustrated embodiment, the force control mechanism 100 is a liquid medium type shock or strut element 100 (hereinafter, "strut"). In further embodiments, other types of shock or strut elements may also be used. The strut 100 minimizes the strain in the trailing cable 22 while passing the shuttle car trailing cable tie-off point by dampening or reducing the strain in the cable 22 when the direction of the cable reel 26 is changed. The tie-off point is a point in the mine where the cable is affixed to the wall. The tie-off point may be near the power source 19 or elsewhere along the travel path of the shuttle car 10. It is at the tie off point where the cable 22 changes direction, which in turns causes a shock on the cable 22. It is this shock that the strut 100 minimizes.

As best shown in FIGS. 2-3, the strut 100 has a generally cylindrical shape. A first end 101 of the strut 100 is secured to the right front 30 of the shuttle car 10 near a compartment for the cable reel 26. A second end 102, opposite the first end 101, is secured to the cable sheave bracket 46.

As discussed above, motion of the sheave assembly 46 is controlled by the strut 100. In a first position, shown in FIG.

3, the strut 100 is in a substantially extended position and the sheave bracket assembly 46 is shown in a retracted position in relation to the right front 30 of the shuttle car 10 forming an obtuse angle (for example approximately 135°) with the right front 30 of the shuttle car 10 relative to a side of the sheave assembly 46 adjacent the strut 100. The strut 100 is configured to be in full extension when the tension in the cable 22 is light. As the cable tension increases at a regular rate to a certain point, the strut 100 begins to contract into a second position, shown in FIG. 2, in which the sheave bracket assembly 46 pivots with respect to the shuttle car 10 and extends substantially perpendicular to the right front 30 of the shuttle car 10. Movement of the sheave bracket assembly 46 results in increased cable tension at a substantially reduced rate until the strut 100 is fully contracted. At this time, cable tension increases at a regular rate. This configuration provides a "virtual" cable lengthening effect, meaning the overall distance covered by the cable 22 lengthens as the strut 100 compresses (or the distance decreases as the strut 100 extends) due to the geometry of the linkage of the bracket assembly 46.

Figure 4:
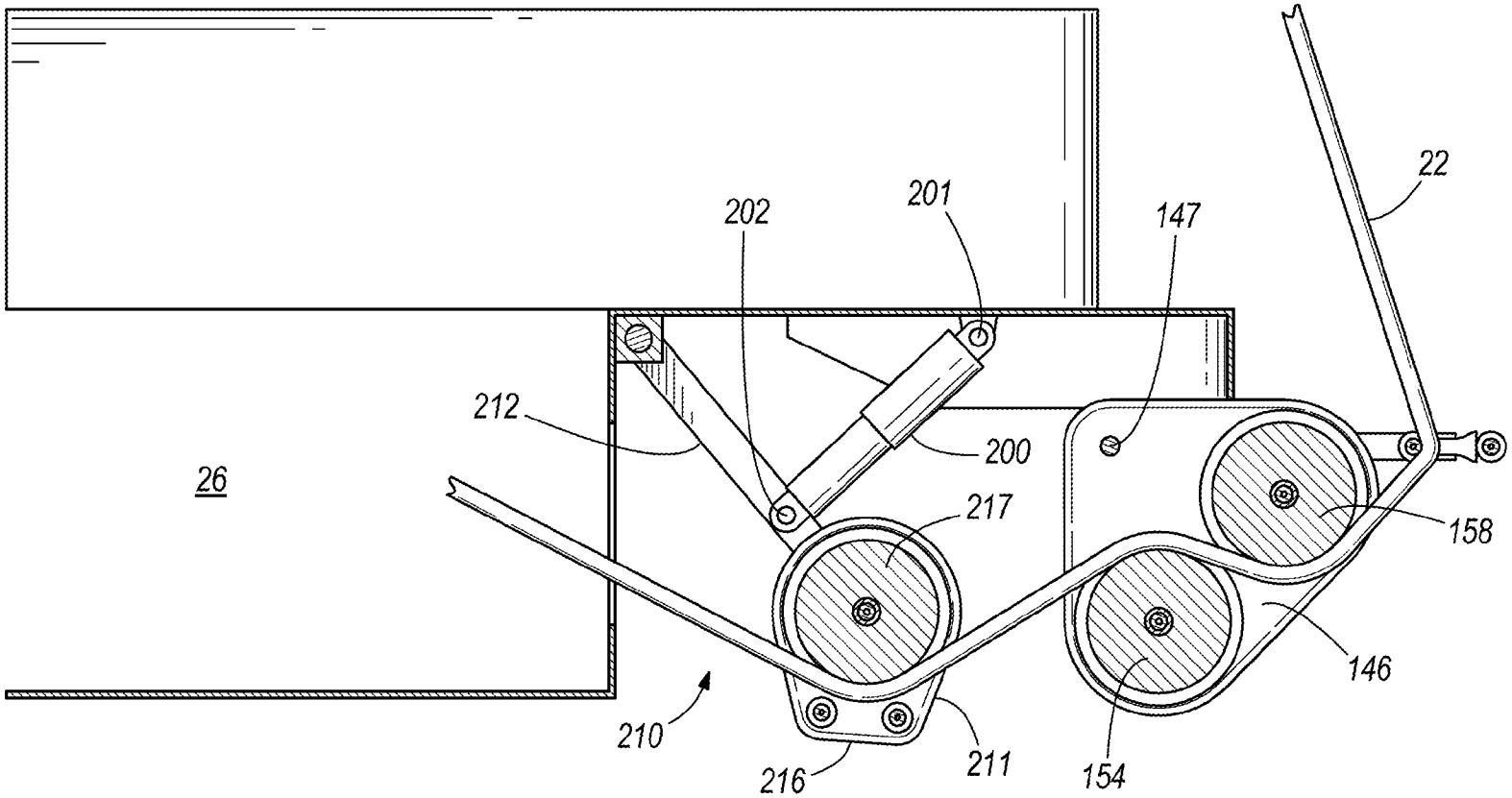
FIG. 4 is a top view of a swinging sheave bracket with a force control mechanism according to another embodiment of the invention.
Figure 5:
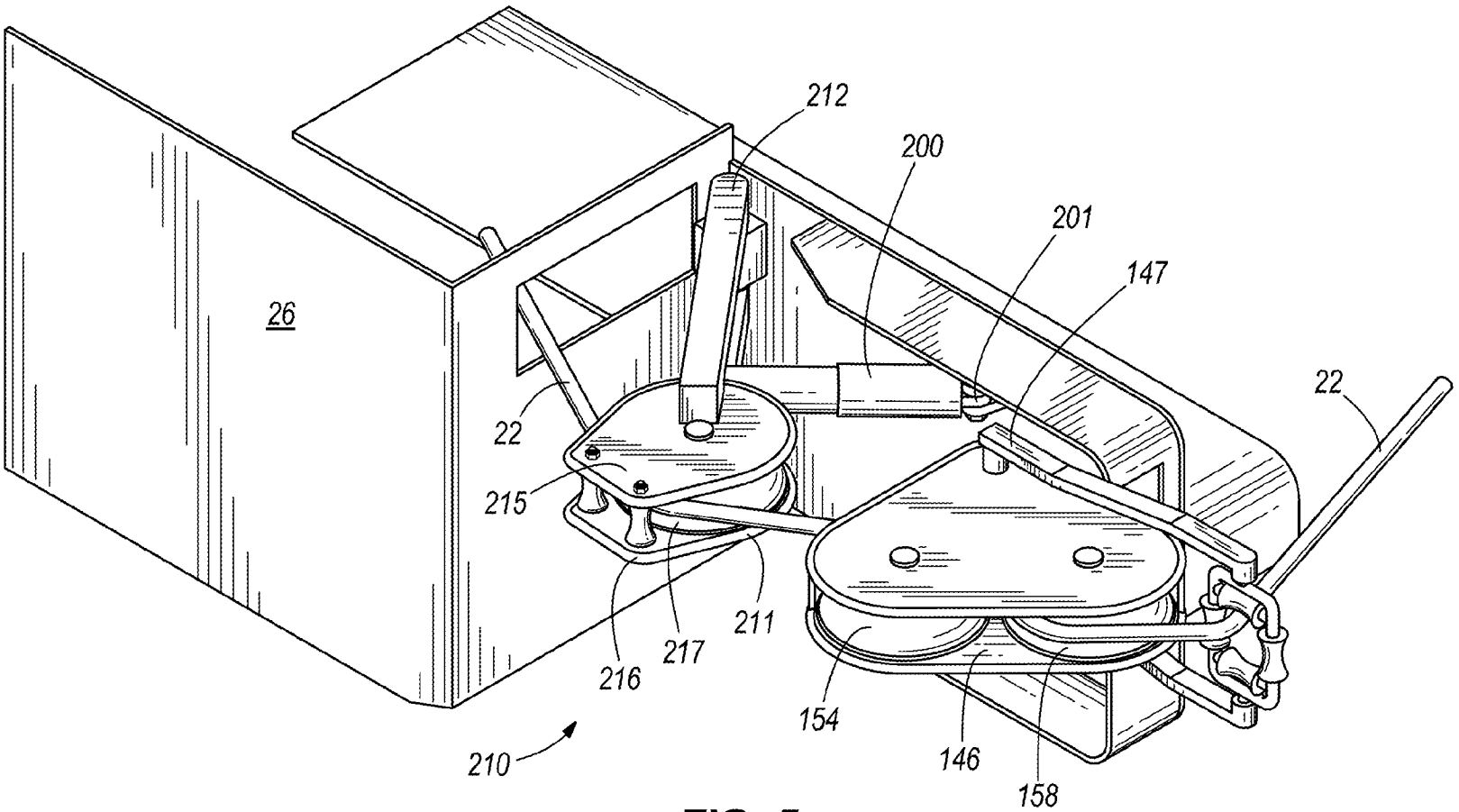
FIG. 5 is a perspective view of the swinging sheave bracket of FIG. 4.

FIGS. 4-5 illustrate a sheave bracket 146 with a roller guide swing arm assembly 210 with a force control mechanism 200 according to another embodiment of the invention. The combination of sheave bracket 146, roller guide assembly 210, and cable guide arm 147 shown in FIGS. 4-5 reduces strain in cable 22 similar to the sheave bracket 46 shown in FIGS. 1-3. The differences will be discussed below and like structure will be given the same reference number plus "100." The force control mechanism 200 is connected to the right front 30 of the shuttle car 10 and includes a second end 202 of the strut 200 that is fixed to a roller guide swing arm assembly 210. The swing arm assembly 210 includes a roller guide 211 and swing arm 212. The roller guide 211 includes a top plate 215, a bottom plate 216, and a sheave 217 therebetween.

In the sheave bracket 146, one end of the swing arm 212 is hinged to the right front 30 of the shuttle car 10 and the other end of the swing arm 212 is fixed to the roller guide 211. One end 201 of the strut 200 is hinged to the right front 30 of the shuttle car 10 and the other end 202 of the strut 200 is fixed to the swing arm 212. Thus, the cable 22 extending from the cable reel 26 passes through the assembly 210 before entering the sheave bracket assembly 146 and cable guide arm 147.

During operation, the sheave bracket 146 functions similarly to the sheave bracket 46, except that the additional assembly 210 in FIGS. 4-5 provides the cable 22 with additional force control.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A sheave bracket for directing a trailing cable of a mining vehicle, the bracket being movably secured to the vehicle and comprising:
- a plate;
- a plurality of sheaves coupled to and extending from the plate, the sheaves being arranged to guide the cable; and
- a control mechanism movable between an extended state and a contracted state to adjust tension in the cable, the control mechanism including a fluid element dampening strain in the cable when a movement direction of the bracket is changed.

2. The bracket of claim 1, wherein the fluid element is a liquid medium type strut element.

3. The bracket of claim 1, wherein the control mechanism has a generally cylindrical shape.

4. The bracket of claim 1, wherein, when the control mechanism is in the extended state, the plate forms an obtuse angle with a wall of the vehicle relative to a side of the plate adjacent the control mechanism.

5. The bracket of claim 4, wherein, when the control mechanism is in the contracted state, the plate is substantially perpendicular with the wall of the vehicle.

6. The bracket of claim 1, wherein the control mechanism is coupled between the plate and a wall of the vehicle.

7. A mining vehicle comprising:
- a frame supported for movement over a surface;
- a motor coupled to the frame for providing power to the vehicle;
- a cable reel coupled to the frame and configured to receive and payout cable as the vehicle moves over the surface; and
- a sheave bracket for directing the cable, the bracket being hingedly secured to the vehicle and comprising:
  - a plate;
  - a plurality of sheaves coupled to and extending from the plate, the sheaves being arranged to guide the cable; and
  - a control mechanism movable between an extended state and a contracted state to adjust tension in the cable, the control mechanism including a fluid element dampening strain in the cable when the direction of the bracket is changed.

8. The vehicle of claim 7, wherein the fluid element includes a liquid medium type shock or strut element.

9. The vehicle of claim 7, wherein the control mechanism has a generally cylindrical shape.

10. The vehicle of claim 7, wherein, when tension in the cable is at a first level, the control mechanism is in the extended state.

11. The vehicle of claim 10, wherein, when tension in the cable is at a second level higher than the first level, the control mechanism is in the contracted state.

12. The bracket of claim 7, wherein the control mechanism is coupled between the plate and a wall of the vehicle.

13. A bracket for guiding a trailing cable of a mining vehicle having at least one wall, the bracket comprising:
- a support member configured to be moveable relative to the wall, the support member movable between a first position and a second position;
- at least one sheave coupled to the support member, each sheave being rotatable relative to the support member, each sheave including an outer surface configured to engage and guide the trailing cable; and
- a control mechanism positioned between the wall of the vehicle and the support member, the control mechanism including a fluid element dampening movement of the support member from at least the first position to the second position.

14. The bracket of claim 13, wherein the fluid element is a liquid medium-type strut damper.

15. The bracket of claim 13, wherein the at least one sheave includes a first sheave and a second sheave, the first sheave and the second sheave coupled to the support member and positioned such that the trailing cable is configured to pass between the outer surfaces of the first sheave and the second sheave.

16. The bracket of claim 13, wherein, when the support member is in the first position, the control mechanism is in an extended state and the support member is oriented at an obtuse angle relative to the wall.

17. The bracket of claim 16, wherein, when the support member is in the second position, the control mechanism is in a contracted state and the support member is oriented substantially perpendicular with respect to the wall.

18. The bracket of claim 13, wherein the control mechanism includes a first end directly coupled to the support member, the control mechanism further including a second end configured to be coupled to the wall.

19. The bracket of claim 13, wherein the support member includes an end configured to be pivotably coupled to the wall.

20. The bracket of claim 13, wherein the support member moves between the first position and the second position in response to a change in tension in the trailing cable.

21. The bracket of claim 20, wherein as the tension in the cable increases, the control mechanism moves from an extended state to a contracted state.

22. The bracket of claim 20, wherein the movement of the support member from the first position to the second position increases the distance covered by the cable.

* * * * *